US007362272B2

(12) United States Patent
Chang et al.

(10) Patent No.: US 7,362,272 B2
(45) Date of Patent: Apr. 22, 2008

(54) CIRCULARLY POLARIZED ANTENNA

(75) Inventors: The-Nan Chang, Taipei (TW); Shih-Wei Lin, Taipei (TW)

(73) Assignees: Tatung Company, Taipei (TW); Tatung University, Taipei (TW)

( * ) Notice: Subject to any disclaimer, the term of this patent is extended or adjusted under 35 U.S.C. 154(b) by 58 days.

(21) Appl. No.: 11/362,824

(22) Filed: Feb. 28, 2006

(65) Prior Publication Data

US 2007/0096989 A1 May 3, 2007

(30) Foreign Application Priority Data

Nov. 1, 2005 (TW) ..... 94138300 A

(51) Int. Cl.
*H01Q 1/38* (2006.01)

(52) U.S. Cl. ..... 343/700 MS; 343/820; 343/732

(58) Field of Classification Search ..... 343/700 MS, 343/820, 732

See application file for complete search history.

(56) References Cited

U.S. PATENT DOCUMENTS 2,953,781 A * 9/1960 Donnellan et al. ..... 342/361
6,952,183 B2 * 10/2005 Yuanzhu ..... 343/700 MS
7,026,998 B2 * 4/2006 Chang et al. ..... 343/700 MS
7,138,949 B1 * 11/2006 Ryken et al. ..... 343/700 MS

* cited by examiner

*Primary Examiner*—Trinh Dinh
*Assistant Examiner*—Dieu Hien T Duong
(74) *Attorney, Agent, or Firm*—Bacon & Thomas, PLLC

(57) ABSTRACT

The present invention relates to techniques to excite a circularly polarized antenna and, more particularly, to a circularly polarized antenna having a QUAD-EMC unit structure. It comprises plural polarized antenna elements; a signal distributor; and a signal coupling element electrically coupled to the polarized antenna elements and electrically connected the signal distributor; wherein, when the circularly polarized antenna is in a transmitting state, the signal coupling element sends the electrical signal from the signal distributor to the polarized antenna elements, and the polarized antenna elements transform the electrical signal into the circularly polarized signal and transmit the circularly polarized signal thereafter; when the circularly polarized antenna is in a receiving state, the polarized antenna elements receive the circularly polarized signal and transform the circularly polarized signal into the electrical signal, and the signal coupling element sends the electrical signal from the polarized antenna elements to the signal distributor.

5 Claims, 8 Drawing Sheets

CIRCULARLY POLARIZED ANTENNA

BACKGROUND OF THE INVENTION

1. Field of the Invention

The present invention relates to techniques to excite a circularly polarized antenna and, more particularly, to a circularly polarized antenna having a QUAD-EMC unit structure.

2. Description of Related Art

In the application field of mobile communication (such as the communication between mobile phone and base station), the mobile communication end point (e.g. mobile phone) in any state (for example, mobile phone is held horizontally or vertically by the user) must completely receive the signal coming from the fixed part (e.g. the base station) so it usually makes use of a circular polarized (CP) signal.

The circularly polarized antenna nowadays has structure of a single polarized antenna element, as shown in FIG. 1A. The polarized antenna element 11 electrically connects to the conducting bar 111 with a function of distributing signals, and the conducting bar 111 electrically connects to a signal distributor, which is not shown in the figure. Besides, the two diagonal corners of the polarized antenna element 11 are chamfered to transmit and receive the circular polarized signal, which is the so-called "chamfered-corner treatment".

However, the CP antenna of this structure is used in conjunction with a narrow bandwidth, which can not be adjusted according to the need in reality. Besides, the gain of this kind of CP antenna is restricted, so it is unable to fit in with the strict requirement of a mobile communication module (e.g. the antenna module of a mobile phone).

Moreover, compared with the above mentioned circularly polarized antenna having the single polarized antenna element, the circularly polarized antenna with a QUAD-EMC unit structure has the following advantages: (1) the gain is better still; (2) adjusting the relative position among every composed polarized antenna can improve the directivity of the transmitted polarized signal and modify the distributing situation of bandwidth.

FIG. 1B is a schematic drawing of a prior art polarized antenna having the QUAD-EMC unit structure. The polarized antenna comprises a grounding substrate 15 and four polarized antenna elements 121, 122, 123, and 124 on its surface. These polarized antenna elements electrically couple with a square conducting plate 13, which has a function of distributing signals, under the bottom surface of substrate 15, and the conducting plate 13 electrically connects to a signal distributor (not shown in the figure) through the conducting bar 14. When the polarized antenna is in a transmitting state, an electrical signal from the signal distributor is sent to the conducting bar 14, where it passes through the square conducting plate 13, and finally is sent to the polarized antenna elements 121, 122, 123, and 124. Then, the polarized antenna elements 121, 122, 123, and 124 transform the electrical signal into a wireless linear polarized (LP) signal and transmit to the environment. When the polarized antenna is in a receiving state, the polarized antenna elements 121, 122, 123, 124 receive the wireless linear polarized (LP) signal from the environment and transform it into an electrical signal. Then the electrical signal is sent to the square conducting plate 13, where it passes through the conducting bar 14, and finally is sent to the signal distributor.

Although the polarized antenna with the QUAD-EMC unit has such advantages, it can transmit and receive only the linear polarized signal, not the circular polarized signal. Hence, this polarized antenna with the QUAD-EMC unit cannot be applied in a mobile phone or any antenna module of mobile communication apparatus.

Therefore, it is desirable for the industries to provide a circular polarized antenna, which not only can transmit and receive the circular polarized signal, but also has a structure of the QUAD-EMC unit, to improve the performance of the mobile phone or any antenna module of mobile communication apparatus.

SUMMARY OF THE INVENTION

The circularly polarized antenna (CP antenna) of the present invention comprises a plurality of polarized antenna elements for transmitting and receiving a circularly polarized signal (CP signal); a signal distributor for distributing an electrical signal; and a signal coupling element electrically coupled to the polarized antenna elements and electrically connected to the signal distributor. When the CP antenna is in a transmitting state, the signal coupling element sends the electrical signal from the signal distributor to the polarized antenna elements, and the polarized antenna elements transform the electrical signal into the CP signal and transmit the CP signal thereafter. When the CP antenna is in a receiving state, the polarized antenna elements receive the CP signal and transform the CP signal into the electrical signal, and the signal coupling element sends the electrical signal from the polarized antenna elements to the signal distributor.

Compared with the conventional CP antenna that has a single polarized antenna element, the gain of the CP antenna of the present invention is better. Moreover, the CP antenna having the QUAD-EMC unit structure still has the same advantage of the conventional CP antenna. Besides, by adjusting the relative position of the polarized antenna element, and adjusting the locations where the signal coupling element is electrically coupled to the polarized antenna elements (i.e. the locations of the coupling points), the directivity of CP signal transmitted by the CP antenna of the present invention can be improved, as well as improving the operating bandwidth region thereof, such as the 3-dB axial ratio bandwidth and the 10-dB return loss bandwidth.

The quantity of the polarized antenna elements that the CP antenna of the present invention comprises is not restricted. Preferably, the quantity of the polarized antenna elements is four. The shape of the polarized antenna element CP antenna of the present invention is not restricted. Preferably, the shape of the polarized antenna element is nearly squared in shape. The corners of the polarized antenna elements can be treated by any conventional method. Preferably, at least one corner of the polarized antenna element is a chamfered-corner. The signal coupling element of the CP antenna of the present invention can be a conductor with any shape. Preferably, the signal coupling element is a coupling-ring or a conductive plate. More preferably, the signal coupling element is a coupling-ring with a shape of a rectangle or a conductive plate with a shape of a square. The polarized antenna elements of the CP antenna of the present invention can be mounted on any suitable printed circuit board. Preferably, the printed circuit board is an FR-4 microwave substrate, a Duroid™ microwave substrate, or a Teflon™ microwave substrate. The signal coupling element of the CP antenna of the present invention can be mounted on any suitable printed circuit board. Preferably, the printed circuit board is an FR-4 microwave substrate, a Duroid™ microwave substrate, or a Teflon™ microwave substrate. The signal distributor of the CP antenna of the present invention can be electrically connected to any kind of signal line. Preferably, the signal line is a coaxial cable, or a copper strand wire. The CP antenna of the present invention can transmit and receive a CP signal at any frequency. Preferably, the frequency of the CP signal ranges from 5.15 to 5.825 GHz.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
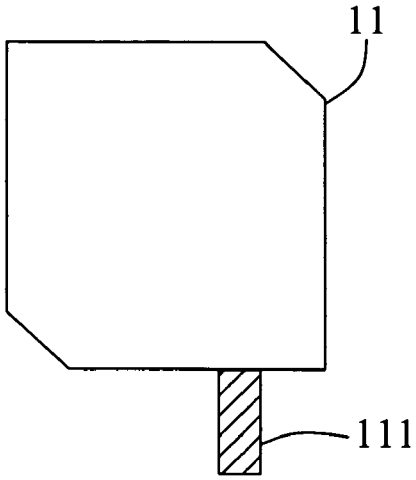
FIG.1A PRIOR ART
FIG. 1A is a schematic drawing of a prior art circularly polarized antenna having a single polarized antenna element.
Figure 1B:
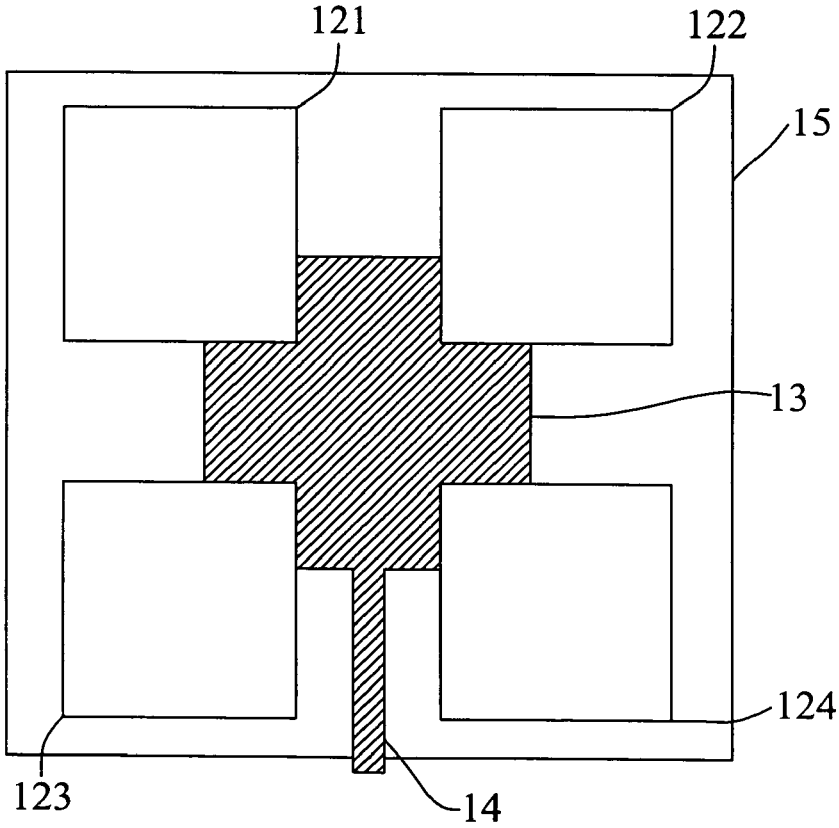
FIG.1B PRIOR ART
FIG. 1B is a schematic drawing of a prior art polarized antenna having a QUAD-EMC unit.
Figure 2A:
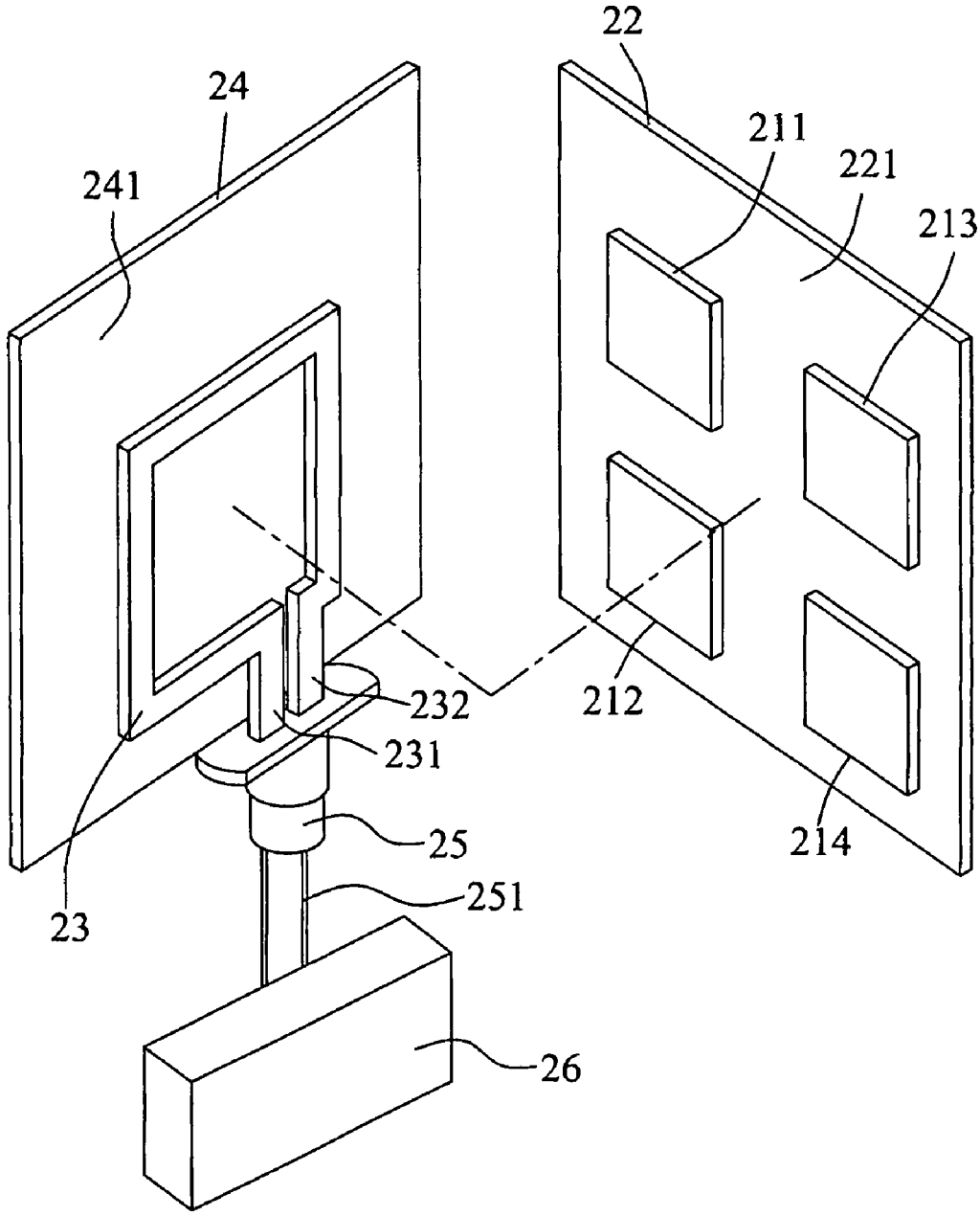
FIG. 2A is a schematic drawing of a circularly polarized antenna according to the first preferred embodiment of the present invention.

FIG. 2A is a schematic drawing of a circularly polarized antenna (CP antenna) according to the first preferred embodiment of the present invention. Polarized antenna elements 211, 212, 213, and 214 are disposed on the upper surface 221 of the first substrate 22. A coupling-ring 23 is disposed on the upper surface 241 of the second substrate 24. The terminals of the coupling-ring are first terminal 231 and second terminal 232, and the terminals 231, and 232 are electrically connected to a converter 25. A coaxial cable 25 is electrically connected to the converter 25 to send an electrical signal to a signal distributor 26 for signal treatment.

Figure 2B:
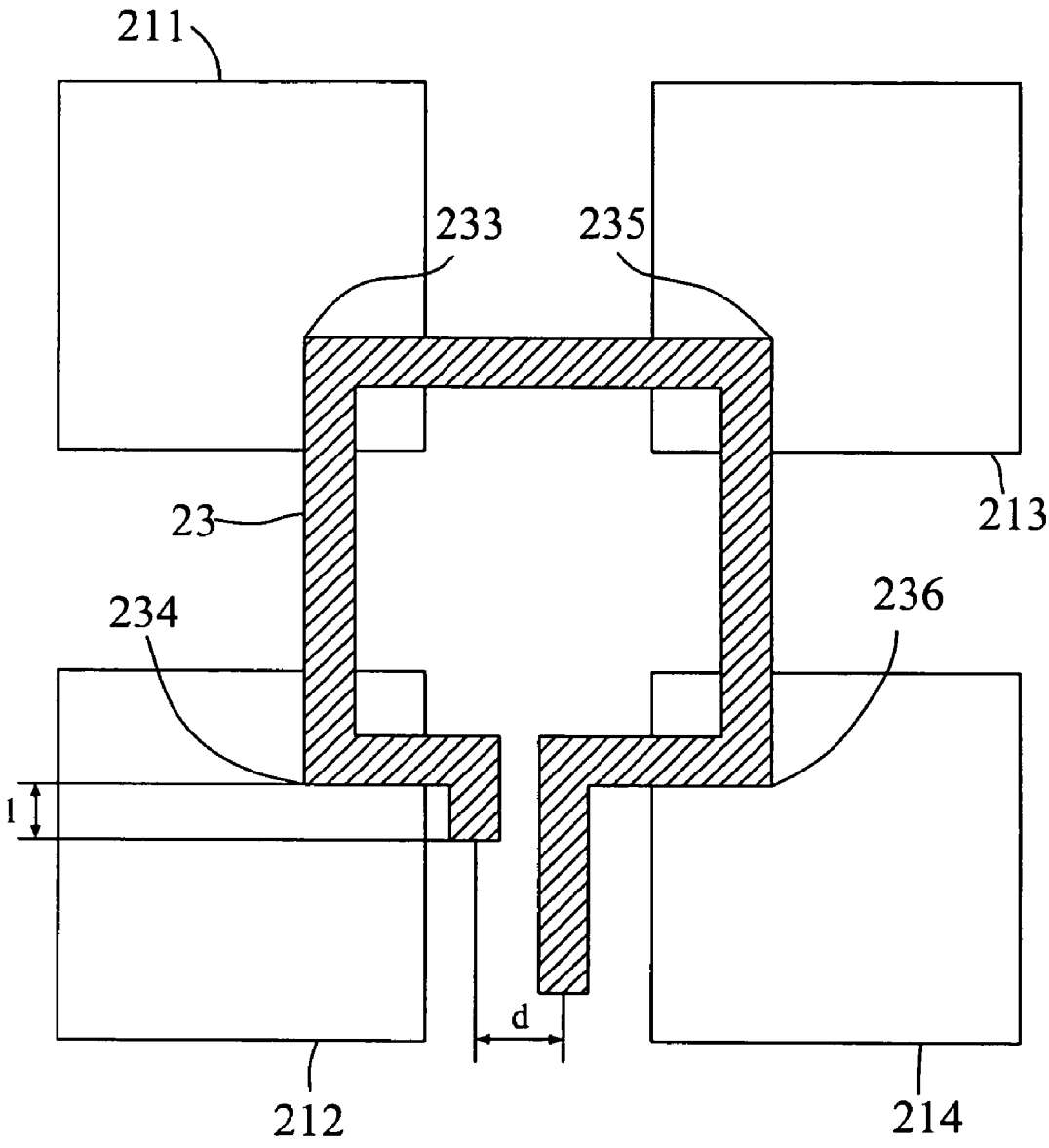
FIG. 2B is a schematic drawing of a circularly polarized antenna in an operating state according to the first preferred embodiment of the present invention.

The first substrate 22 is mounted on the second substrate 24. Afterwards, the first substrate 22 and the second substrate 24 are disposed on a surface of a grounded plate, and a CP antenna is obtained. As shown in FIG. 2B, the polarized antenna elements 211, 212, 213, and 214 are electrically connected to the coupling-ring through the coupling points 233, 234, 235, and 236, respectively. In this embodiment, the first substrate 22 and the second substrate 24 are identical substrates made of FR-4, and they have the same thickness of 1.6 mm. The dimension of the grounded plate is 5 cm×5 cm.

FIG. 2B is a schematic drawing of a circularly polarized antenna in an operating state according to the first preferred embodiment of the present invention. The view of FIG. 2B is directed from the second substrate 24 to the first substrate 22. Besides, in order to simplify the figure, the first substrate 22 and the second substrate 24 are not shown in FIG. 2B. Therefore, FIG. 2B shows the relative position of the polarized antenna elements 211, 212, 213, and 214 and the coupling-ring 23. Tail length (l) and offset distance (d)—two parameters concerning efficiency—are defined in FIG. 2B. The efficiency of the CP antenna of the first preferred embodiment is performed by the 3-dB axial ratio bandwidth and the 10-dB return loss bandwidth of the transmitted signal.

Referring to FIG. 2B, the polarized antenna elements 211, 212, 213, and 214 all have a dimension of 12 mm×11 mm, and are nearly squared in shape. Each polarized antenna element can support two degenerate states, and therefore, the CP antenna can transmit and receive circularly polarized signals (CP signal). The distance between two adjacent polarized antenna elements is 7 mm.

In another aspect, the width of the coupling-ring 23 is 1.5 mm, the length of the coupling-ring between coupling points 235 and 233 is 13 mm, and the length of the coupling-ring between coupling points 235 and 236 is 14 mm. As to the optimum location of the coupling points, the approximate location of the coupling points is decided by probe-feed reference design, and then tested by a software through a trial-and-error process to obtain the optimum location of the coupling points.

Table 1 shows the simulated results of the CP antenna of the first preferred embodiment as shown in FIG. 2B and it shows that the axial ratio and the return loss of the CP antenna variably depend on the increase of the tail length (l).

TABLE 1

| | Axial ratio | | Return loss | |
|---|---|---|---|---|
| | Center frequency | 3-dB bandwidth | Center frequency | 10-dB bandwidth |
| l = 1 mm | 6.043 GHz | 112 MHz | 5.45 GHz | 700 MHz |
| l = 2 mm | 5.943 GHz | 129 MHz | 5.4 GHz | 600 MHz |
| l = 3 mm | 5.813 GHz | 157 MHz | 5.35 GHz | 600 MHz |
| l = 4 mm | 5.657 GHz | 195 MHz | 5.325 GHz | 550 MHz |
| l = 4.5 mm | 5.455 GHz | 140 MHz | 5.325 GHz | 550 MHz |
| l = 5 mm | 5.373 GHz | 97 MHz | 5.3 GHz | 600 MHz |

In table 1, the optimum frequency of the CP antenna of the first preferred embodiment is around 5.3 GHz, as the tail length (l) is 5 mm. Generally speaking, the longer the tail length, the longer the coupling-ring, the lower the center frequency within the axial ratio bandwidth region. However, the center frequency within the return loss bandwidth region has no obvious changes while tuning the tail length. Moreover, at certain specific tail lengths, the center frequency within the return loss bandwidth region has only slight changes. Therefore, the CP antenna of the first preferred embodiment can obtain very similar or identical center frequency within an axial ratio bandwidth and within a return loss bandwidth by tuning the tail length or the spacing between the polarized antenna elements.

Figure 3:
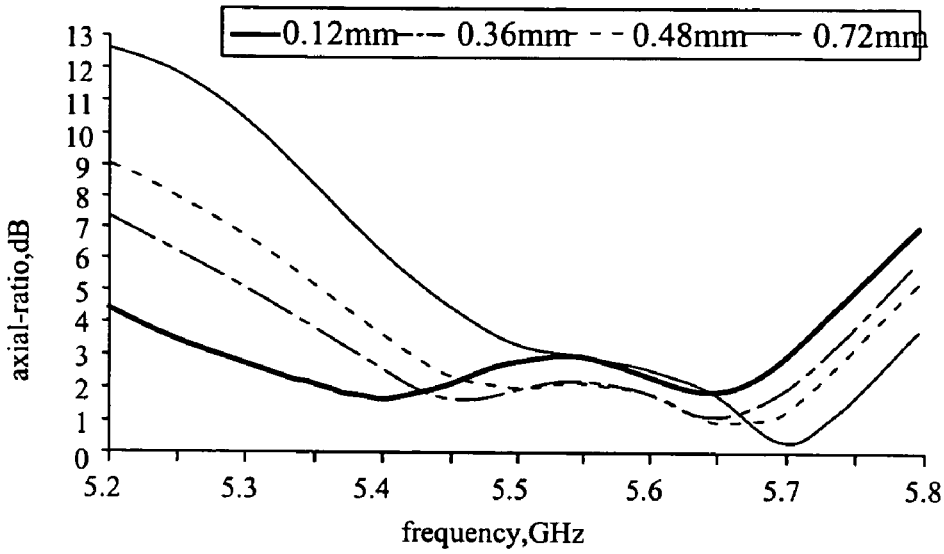
FIG. 3 is a schematic drawing of the axial ratio vs. the frequency as the tail length (l) as shown in FIG. 2B is 6 mm.
Figure 4:
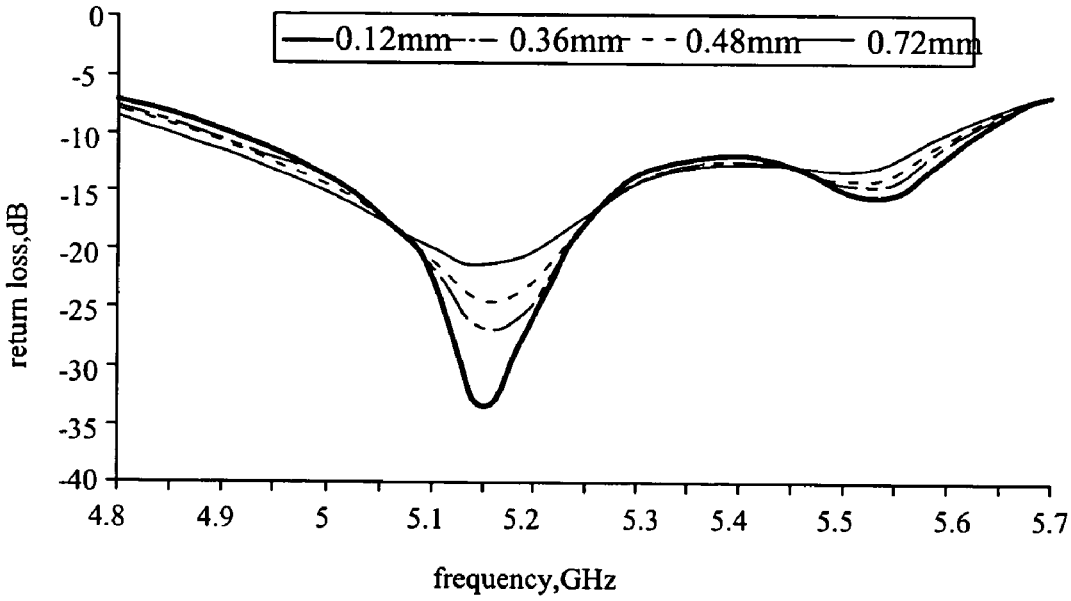
FIG. 4 is a schematic drawing of the return loss vs. the frequency as the tail length (l) as shown in FIG. 2B is 6 mm.

FIG. 3 is a schematic drawing of the axial ratio vs. the frequency, which shows that the axial ratio of the transmitted CP signal variably depends on the increase of the offset distance (d), while the tail length (l) as shown in FIG. 2B is 6 mm. FIG. 4 is a schematic drawing of the return loss vs. the frequency, which shows that the return loss of the transmitted CP signal variably depends on the increase of the offset distance (d), while the tail length (l) as shown in FIG. 2B is 6 mm. In FIGS. 3 and 4, the offset distance is increased from 0.12 mm to 0.72 mm.

Regardless of the offset distance, FIGS. 3 and 4 also show that the 10-dB return loss bandwidth is wider than the 3-dB axial ratio bandwidth of the transmitted CP signal. Besides, both of the bandwidths are wider than the predetermined working frequency range of the CP antenna, i.e. the United State U-NII band. In this embodiment, the predetermined working frequency ranges from 5.15 GHz to 5.825 GHz. Therefore, the CP antenna of the first preferred embodiment can transmit and receive CP signals at its predetermined working frequency range.

Figure 5A:
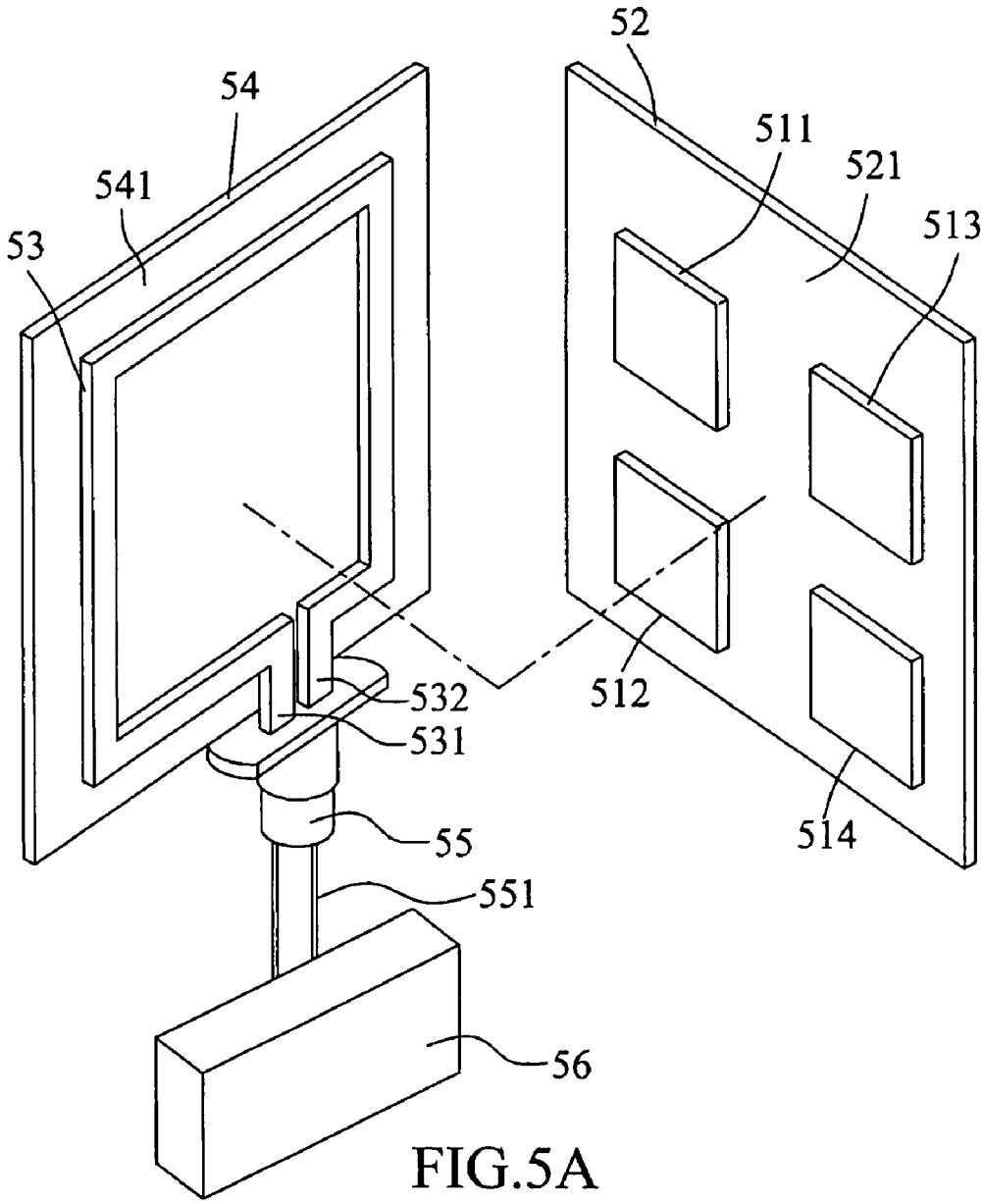
FIG. 5A is a schematic drawing of a circularly polarized antenna according to the second preferred embodiment of the present invention.

FIG. 5A is a schematic drawing of a CP antenna according to the second preferred embodiment of the present invention. Polarized antenna elements 511, 512, 513, and 514 are disposed on the upper surface 521 of the first substrate 52. A coupling-ring 53 is disposed on the upper surface 541 of the second substrate 24. The terminals of the coupling-ring are first terminal 531 and second terminal 532, and the terminals 531, and 532 are electrically connected to a converter 55. A coaxial cable 551 is electrically connected to the converter 55 to send an electrical signal to a signal distributor 56 for signal treatment.

The first substrate 52 is mounted on the second substrate 54. Afterward, the first substrate 52 and the second substrate 54 are disposed on a surface of a grounded plate, and a CP antenna is obtained. As shown in FIG. 2B, the polarized antenna elements 511, 512, 513, and 514 are electrically connected to the coupling-ring through the coupling points 533, 534, 535, and 536, respectively. In this embodiment, the first substrate 52 and the second substrate 24 are identical substrates made of FR-4, and they have the same thickness of 1.6 mm. The dimension of the grounded plate is 5 cm×5 cm.

Figure 5B:
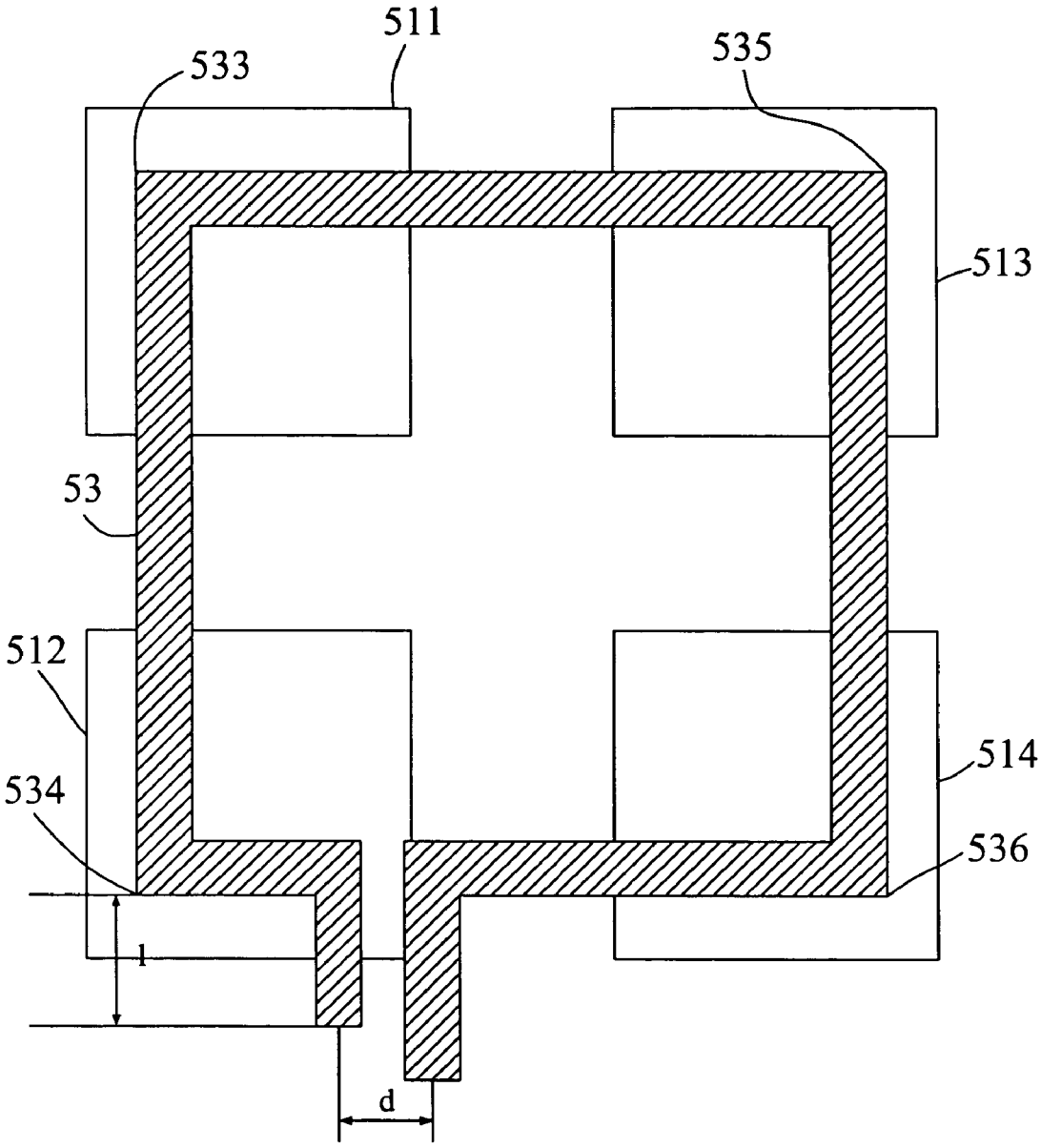
FIG. 5B is a schematic drawing of a circularly polarized antenna in an operating state according to the second preferred embodiment of the present invention.

FIG. 5B is a schematic drawing of a CP antenna in an operating state according to the second preferred embodiment of the present invention. The view of FIG. 5B is directed from the second substrate 54 to the first substrate 52. Besides, in order to simplify the figure, the first substrate 52 and the second substrate 54 are not shown in FIG. 5B. Therefore, FIG. 5B shows the relative position of the polarized antenna elements 511, 512, 513, and 514 and the coupling-ring 53. Tail length (l) and offset distance (d)—two parameters concerning efficiency—are defined in FIG. 5B. The efficiency of the CP antenna of the second preferred embodiment is shown by the 3-dB axial ratio bandwidth and the 10-dB return loss bandwidth of the transmitted signal.

Referring to FIG. 5B, the polarized antenna elements 211, 212, 213, and 214 all have a dimension of 12 mm×11 mm, and are similar to a square in shape. The border-length of them is approximately half of the predetermined wavelength of the transmitting or receiving CP signal of the second preferred embodiment. The nearly squared antenna element can support two degenerate states, and the CP antenna can transmit and receive CP signals. The distance between two adjacent polarized antenna elements is 7 mm.

In another aspect, the width of the coupling-ring 53 is 1.5 mm, the length of the coupling-ring between coupling points 535 and 533 is 23 mm, and the length of the coupling-ring between coupling points 535 and 536 is 22 mm. Therefore, the length of the whole coupling-ring 53 is approximately four times the wavelength of the CP signal transmitted by the CP antenna of the second preferred embodiment.

Besides, compared with the coupling-ring 23 of the first preferred embodiment, the coupling-ring 53 of the second preferred embodiment is larger, and the coupling-ring 53 has more space to regulate the offset distance (d). Hence, the efficiency of the CP antenna of the second preferred embodiment, such as the 3-dB axial ratio bandwidth and the 10-dB return loss bandwidth, is better than that of the first preferred embodiment.

Table 2 shows the simulated results of the CP antenna of the second preferred embodiment as shown in FIG. 5B and it shows that the axial ratio and the return loss of the CP antenna variably depend on the increase of the tail length (l) while the offset distance is zero.

TABLE 2

| | Axial ratio | | Return loss | |
|---|---|---|---|---|
| | Center frequency | 3-dB bandwidth | Center frequency | 10-dB bandwidth |
| L = 2 mm | No CP wave | No CP wave | 5.436 GHz | 920 MHz |
| L = 3 mm | No CP wave | No CP wave | 5.376 GHz | 826 MHz |
| L = 4 mm | No CP wave | No CP wave | 5.326 GHz | 750 MHz |
| L = 4.5 mm | No CP wave | No CP wave | 5.31 GHz | 733 MHz |
| L = 5 mm | 5.61 GHz | 372 MHz | 5.298 GHz | 720 MHz |
| l = 5.5 mm | 5.54 GHz | 425 MHz | 5.29 GHz | 715 MHz |
| l = 6 mm | 5.335 GHz | 230 MHz | 5.286 GHz | 712 MHz |

In table 2, the optimum frequency of the CP antenna of the second preferred embodiment is approximately 5.3 GHz, as the tail length (l) is 6 mm.

Figure 6:
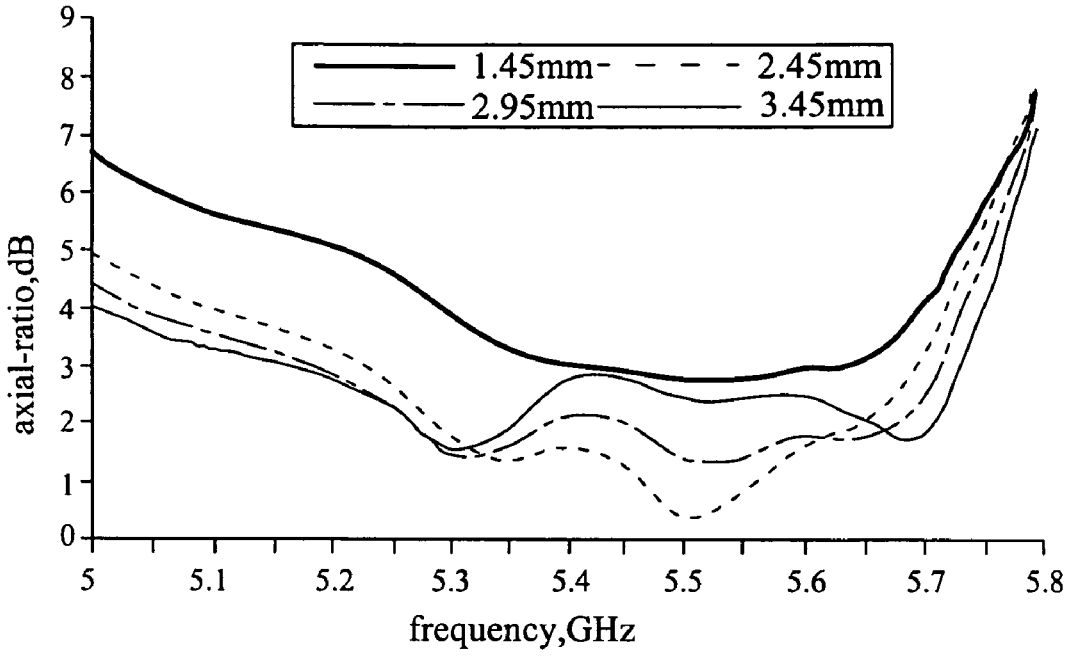
FIG. 6 is a schematic drawing of the axial ratio vs. the frequency as the tail length (l) as shown in FIG. 5B is 6 mm.
Figure 7:
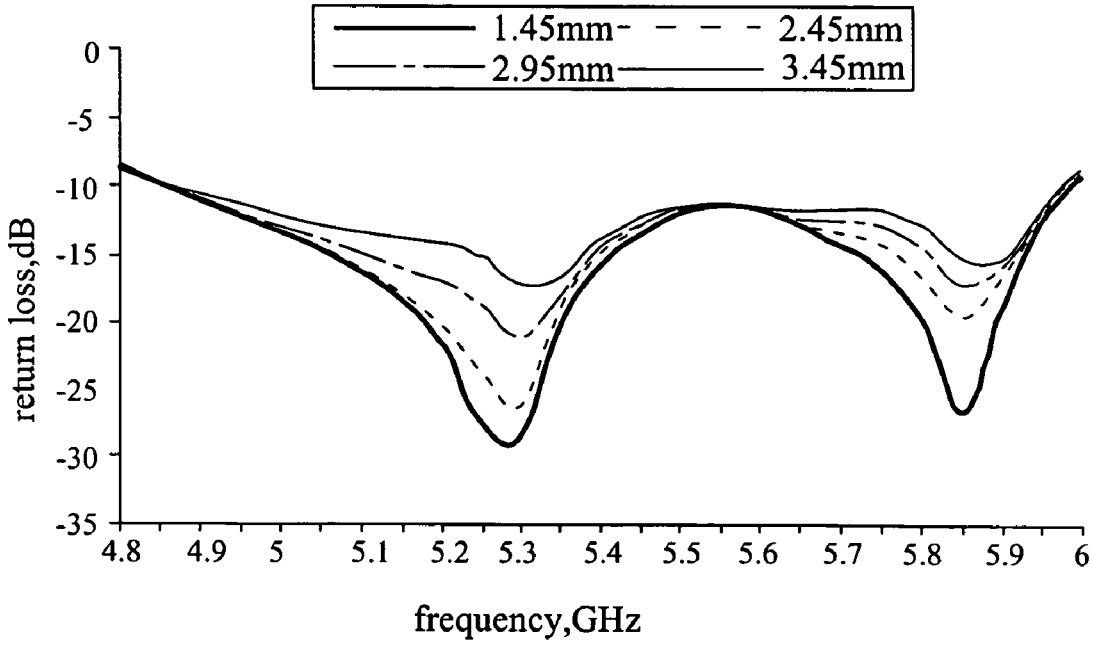
FIG. 7 is a schematic drawing of the return loss vs. the frequency as the tail length (l) as shown in FIG. 5B is 6 mm.

FIG. 6 is a schematic drawing of the axial ratio vs. the frequency, which shows that the axial ratio of the transmitted CP signal variably depends on the increase of the offset distance (d), while the tail length (l) as shown in FIG. 5B is 6 mm. FIG. 7 is a schematic drawing of the return loss vs. the frequency, which shows that the return loss of the transmitted CP signal variably depends on the increase of the offset distance (d), while the tail length (l) as shown in FIG. 5B is 6 mm. In FIGS. 6 and 7, the offset distance is increased from 1.45 mm to 3.45 mm.

Regardless of the offset distance, FIGS. 6 and 7 show that the 10-dB return loss bandwidth is wider than the 3-dB axial ratio bandwidth of the transmitted CP signal. Besides, both of the bandwidths are wider than the predetermined working frequency range of the CP antenna, i.e. the United State U-NII band. In this embodiment, the predetermined working frequency ranges from 5.15 GHz to 5.825 GHz. Therefore, the CP antenna of the second preferred embodiment can transmit and receive CP signals at its predetermined working frequency range.

Moreover, the CP antenna of the second preferred embodiment has two resonant frequencies at 5.3 GHz and 5.85 GHz as shown in FIGS. 6 and 7. It is also seen that equal return loss is obtainable at these resonant frequencies, and the axial ratio at these resonant frequencies is the lowest in FIGS. 6 and 7. Hence, the CP antenna of the second preferred embodiment can transmit CP signals at these two frequencies simultaneously.

Figure 8:
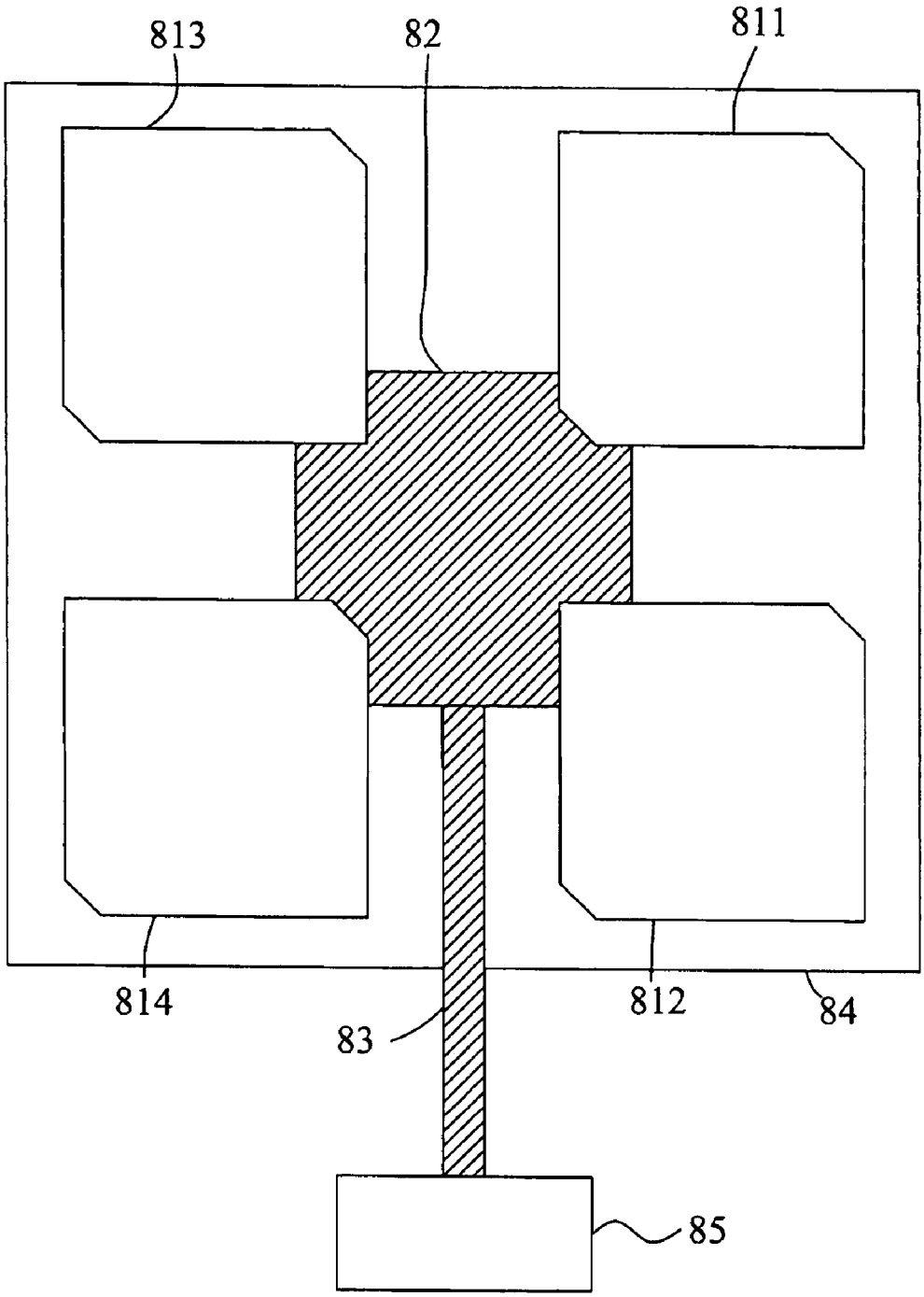
FIG. 8 is a schematic drawing of a circularly polarized antenna in an operating state according to the third preferred embodiment of the present invention.

FIG. 8 is a schematic drawing of a circularly polarized antenna in an operating state according to the third preferred embodiment of the present invention. FIG. 8 shows the relative position of the polarized antenna elements 811, 812, 813, and 814 and the conductive plate 82. These polarized antenna elements 811, 812, 813, and 814 are all similar to a square in shape, and they are all electrically connected to the conductive plate 82, which has a function of coupling signals, and are electrically connected to a signal distributor 85 through a conducting strip 83. Besides, the diagonal corners of each polarized antenna element 811, 812, 813, and 814 are chamfered.

These chamfered polarized antenna elements 811, 812, 813, and 814 can provide two degenerate states, and the CP antenna of the third preferred embodiment therefore can transmit and receive CP signals. Compared with the first and the second embodiments, the 3-dB axial ratio bandwidth and the 10-d-B return loss bandwidth of the CP signal transmitted by the CP antenna of the third preferred embodiment is narrower. However, these two bandwidths of the third preferred embodiment are wider than that of the conventional CP antenna having a single polarized antenna element.

Therefore, the CP antenna of the present invention can transmit and receive CP signals. Besides, the gain of the CP antenna of the present invention is better than that of the conventional CP antenna that has a single polarized antenna element. Moreover, the CP antenna having the QUAD-EMC unit structure still has the same advantage of the conventional CP antenna. By tuning the relative position of the polarized antenna element, and tuning the locations whereat the signal coupling element is electrically coupled to the polarized antenna elements (i.e. the locations of the coupling points), the bandwidth of CP signals transmitted by the CP antenna of the present invention can be improved. As shown in FIG. 2B and FIG. 5B, the coupling points of these two embodiments are all located on four corners of the coupling-rings, besides, the coupling-ring of the first preferred embodiment is smaller than that of the second preferred embodiment. Therefore, the relative positions of the coupling point 232 in FIG. 2B and the coupling point 532 in FIG. 5B are almost symmetrical to the center point of the polarized antenna element 211 or 511, and the relative positions of the coupling points (234, 534), (235,535), or (236,536) are also symmetrical to the center points of the polarized antenna element 212, 213, or 214, respectively.

Furthermore, the directivity of the CP signal transmitted by the CP antenna of the present invention is improved, and the operation bandwidth, such as the 3-dB axial ratio bandwidth and the 10-dB return loss bandwidth is increased.

Although the present invention has been explained in relation to its preferred embodiment, it is to be understood that many other possible modifications and variations can be made without departing from the scope of the invention as hereinafter claimed.

What is claimed is:

1. A circularly polarized antenna; comprising:

a plurality of polarized antenna elements for transmitting and receiving a circularly polarized signal;

a signal distributor for distributing an electrical signal; and a signal coupling element electrically coupled to the polarized antenna elements and electrically connected to the signal distributor;

wherein, the signal coupling element is a coupling-ring and when the circularly polarized antenna is in a transmitting state, the signal coupling element sends the electrical signal from the signal distributor to the polarized antenna elements, and the polarized antenna elements transform the electrical signal into the circularly polarized signal and transmit the circularly polarized signal thereafter; when the circularly polarized antenna is in a receiving state, the polarized antenna elements receive the circularly polarized signal and transform the circularly polarized signal into the electrical signal, and the signal coupling element sends the electrical signal from the polarized antenna elements to the signal distributor; wherein the plurality of polarized antenna elements is four square-shaped polarized antenna elements.

2. The circularly polarized antenna as claimed in claim 1, wherein at least one corner of the polarized antenna element is a chamfered-corner.

3. The circularly polarized antenna as claimed in claim 1, wherein two terminals of the coupling ring are electrically connected to the signal distributor.

4. The circularly polarized antenna as claimed in claim 1, wherein the signal distributor is electrically connected to a coaxial cable.

5. The circularly polarized antenna as claimed in claim 1, wherein the frequency of the circularly polarized signal ranges from 5.15 to 5.825 GHz.

* * * * *